United States Patent [19]

Goetsch

[11] 4,226,161

[45] Oct. 7, 1980

[54] ACCORDION SUPPORT APPARATUS

[76] Inventor: Elmer A. Goetsch, 3119 Grimes Ave. North, Minneapolis, Minn. 55422

[21] Appl. No.: 944,575

[22] Filed: Sep. 21, 1978

[51] Int. Cl.[3] ..... G10G 5/00

[52] U.S. Cl. ..... 84/376 A; 84/327; 224/910

[58] Field of Search ..... 84/376 A, 376, 327, 84/385 A; 224/270, 908–910

[56] References Cited

U.S. PATENT DOCUMENTS

| | | | |
|---|---|---|---|
| 817,207 | 4/1906 | Wheeler | 224/908 |
| 1,637,003 | 7/1927 | Lang | 84/385 A X |
| 1,660,740 | 2/1928 | Bailey | 84/385 A X |
| 2,484,383 | 10/1949 | Lee | 224/270 |
| 2,643,803 | 6/1953 | Bates | 224/909 |
| 3,037,416 | 6/1962 | Cunningham | 84/327 |
| 4,033,488 | 7/1977 | Brewer | 224/908 |

FOREIGN PATENT DOCUMENTS

| | | | |
|---|---|---|---|
| 921731 | 12/1954 | Fed. Rep. of Germany | 84/376 A |
| 1090429 | 11/1967 | United Kingdom | 242/84.8 |

*Primary Examiner*—L. T. Hix
*Assistant Examiner*—Shelley Wade
*Attorney, Agent, or Firm*—Burd, Bartz & Gutenkauf

[57] ABSTRACT

An accordion support apparatus having an elongated flexible belt surrounding the waist of the player. The belt is hooked to a ring attached to a link. The link has an end fastened to the lower part of the treble section of an accordion. The weight of the accordion is transferred through the link to the belt surrounding the waist of the player. The link has a structure for adjusting the length of the link to enable the player to move the accordion to a convenient playing position when the player is standing or seated.

18 Claims, 7 Drawing Figures

FIG. 1
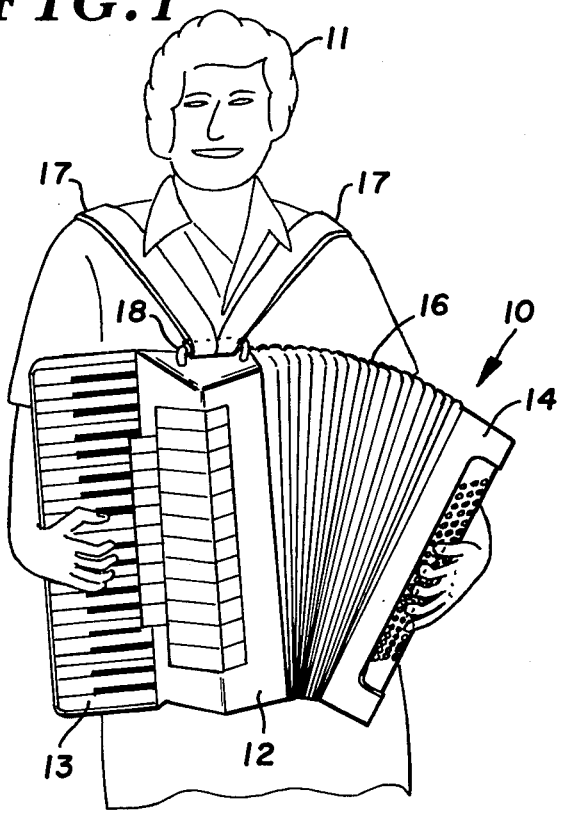
FIG. 2
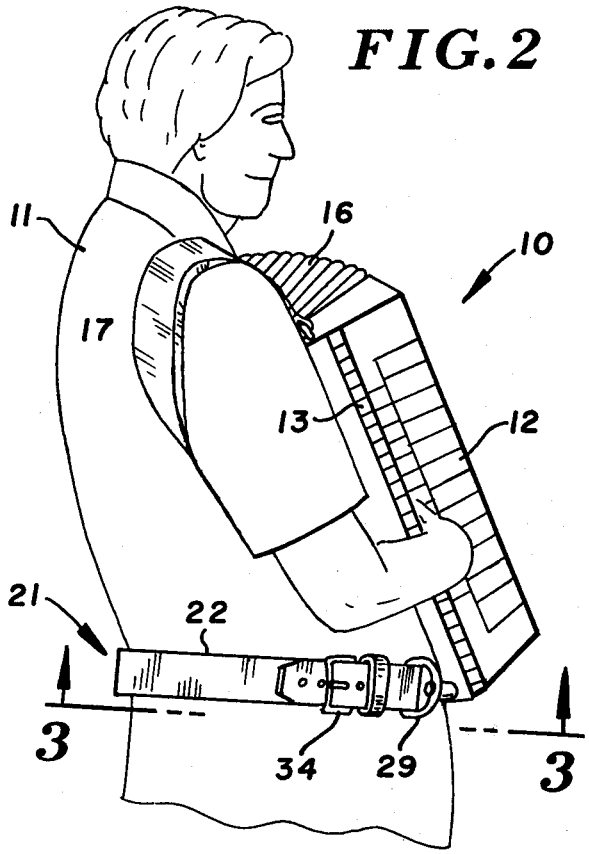
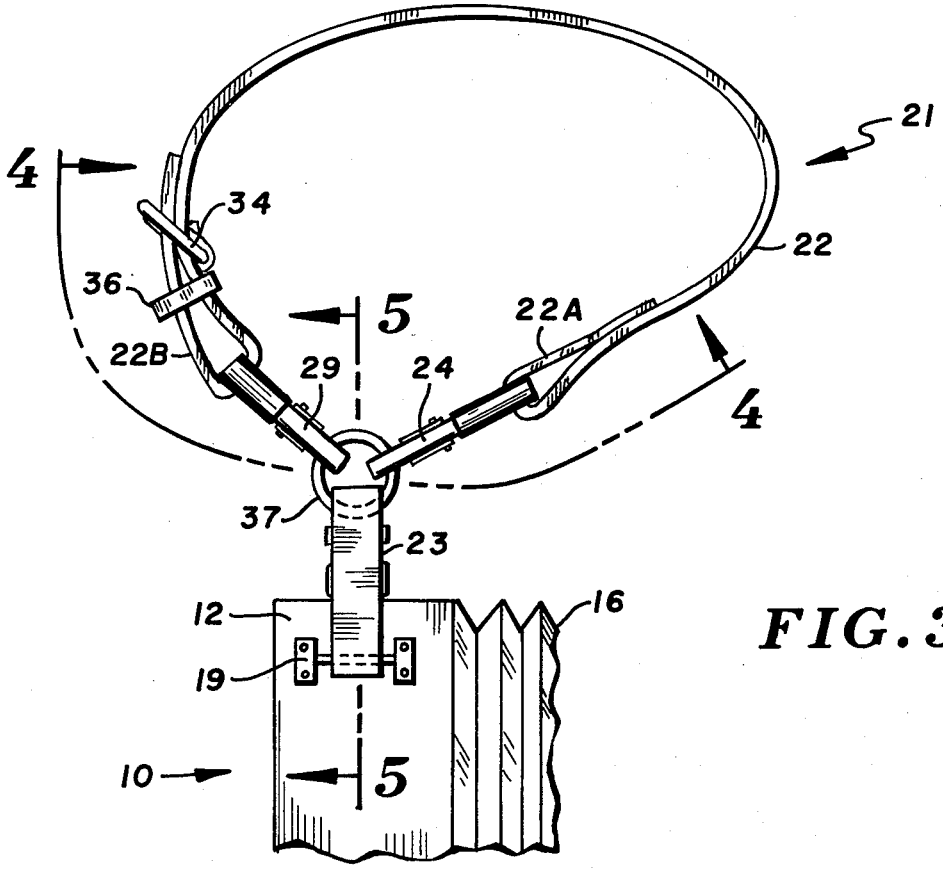
FIG. 3

ACCORDION SUPPORT APPARATUS

SUMMARY OF THE INVENTION

The invention is directed to an apparatus to support an instrument, such as an accordion, in a playing position on the waist of a person. Conventionally, an accordian is carried by a musician with the use of two shoulder straps. The shoulder straps are connected to the upper and lower ends of the treble section of the accordion. Each strap has a length such that it extends over a shoulder of the musician. All of the weight of the accordion is carried by the shoulders of the musician to relieve the player's arms of this weight. Some accordion models have a weight of 50 or more pounds. This weight becomes a burden to the player over an extended period of time.

The accordion support apparatus of the invention functions to minimize the weight of the accordion on the shoulders of the musician. The apparatus supports the accordion from the waist of the musician. Shoulder straps are used to stabilize the instrument in front of the musician. The accordion support apparatus allows the musician to locate the accordion in a convenient playing position and permits the player to play the accordion in both standing and sitting positions. The accordion support apparatus is readily detachable so that it can be removed from the waist of the player with a minimum of time.

The accordion support apparatus has an elongated flexible belt adapted to surround the waist of the player. The belt has a buckle which is used to adjust the length of the belt so that it can fit around the waist of different players. A flexible link, as a strap, has a first end connected to the lower end of the accordion. The conventional accordion hardware is used to accommodate the link. The free or outer end of the link carries a rigid ring. Snap hooks connected to opposite ends of the belt hook into the ring so that the belt circumvents the waist of the player. The link has means for adjusting its length so that the player can adjust the playing height of the accordion. In one form of the invention an extendable and contractable unit is used to provide a quick and automatic adjustment of the playing position in front of the player. The extendable and contractable unit has an elastic link that is expandable to increase the length of the link. A releasable lock is used to hold the link in an adjusted position. When the lock is released the extendable and contractable unit will contract to its retracted position and thereby decrease the length of the link.

IN THE DRAWINGS

FIG. 1 is a perspective view of an accordion carried by a player with the accordion support apparatus of the invention;

FIG. 2 is a side view of the player, accordion, and accordion support apparatus of FIG. 1;

FIG. 3 is a fragmentary view of the accordion and an enlarged view of the accordion support apparatus taken along line 3—3 of FIG. 2;

DESCRIPTION OF PREFERRED EMBODIMENTS

Figure 4:
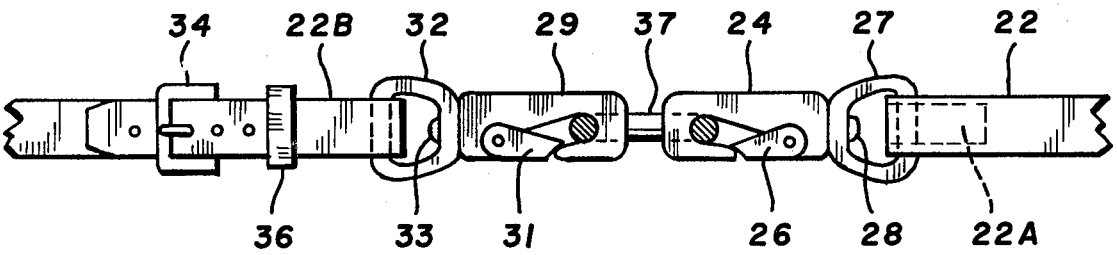
FIG. 4 is a sectional view taken along line 4—4 of FIG. 3.

Referring to FIGS. 1 and 2, there is shown an accordion indicated generally at 10. Accordion 10 is a musical instrument that is carried by a player or musician 11 in either the standing or sitting position. Accordion 10 has a treble section 12, including a keyboard 13, and a base section 14 connected to treble section 12 with a bellows 16. A pair of shoulder straps 17 are joined to the top of treble section 12 with a top U-member or hardware 18. Straps 17 extend upwardly over the shoulders of musician 11 and then down over the back of musician 11 to the bottom of treble section 12. A bottom U-member or hardware 19 is coupled to shoulder straps 17 to the bottom of treble section 12. Shoulder straps 17 can each be a two-piece strap that is adjustably connected together. For example, each strap 17 can have a buckle so that the length of the strap can be adjusted. Straps 17 are conventional accordion shoulder straps used to support the weight of the accordion from the shoulders of the player. The conventional shoulder straps are used to relieve the player's arms of the weight of the accordion thereby freeing the arms and hands for the operation of the accordion.

Referring to FIGS. 2, 3 and 4, there is shown an accordion support apparatus, indicated generally at 21, for carrying accordion 10 on the musician's waist. Apparatus 21 is used with shoulder straps 17 to locate accordion 10 in a playing position in front of musician 11. Shoulder straps 17 stabilize accordion 10 in front of musician 11. Accordion support apparatus 21 transfers the weight of accordion 10 to the musician's waist thereby relieving substantially all of the weight of the accordion from shoulder straps 17. Apparatus 21 is adjustable to locate the accordion 10 in a selected elevation and lateral distance from in front of the musician.

Accordion support assembly 21 has a flexible belt 22 that encircles the waist of musician 11. Belt 22 can be an elongated strap-like flexible member of leather, plastic, or the like. A strap or link assembly 23 connects belt 22 to the bottom member or hardware 19 on treble section 12 of accordion 10. Link assembly 23 can be an endless flexible member connecting the belt 22 to the lower end of accordion section 12.

Referring to FIG. 4, belt 22 has a first releasable connector or snap hook 24 carrying a releasing safety catch or pivot latch 26. Hook 24 is rotatably joined to a D-ring or loop 27 with a stub projection 28 which allows hook 24 to rotate relative to loop 27. Loop 27 is connected to one end 22A of belt 22. End 22A is turned back and attached with stitches or the like to a portion of belt 22 with a part of loop 27 located between parts of belt 22.

A second releasable connector or snap hook 29 having a releasable pivot latch 31 is connected to the second end 22B of belt 22 with a loop or D-shaped ring 32. Hook 29 has an axial stub projection 33 providing a swivel connection to loop 32. The second end 22B of belt 22 has a buckle 34 used to adjust the length of belt 22. A belt circling or retaining loop 36 is located between buckle 34 and loop 32.

Figure 5:
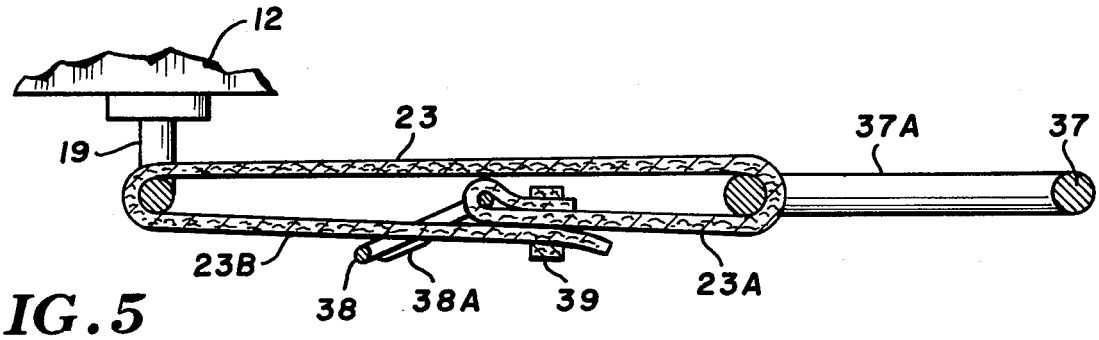
FIG. 5 is an enlarged sectional view taken along line 5—5 of FIG. 3.

A ring 37, as a metal ring, is connected to the free end of strap 23, which is remote from accordion 12. Referring to FIG. 5, strap 23 has an end 23A extended through the opening 37A in ring 37. A buckle 38 is attached to end 23A of strap 38. Buckle 38 has the usual finger 38A adapted to project through a hole in end portion 23B of belt 23 whereby the length of strap 23 can be adjusted. A belt circling or retaining loop 39 holds end 23B extended from buckle 38 adjacent end 23A.

Figure 6:
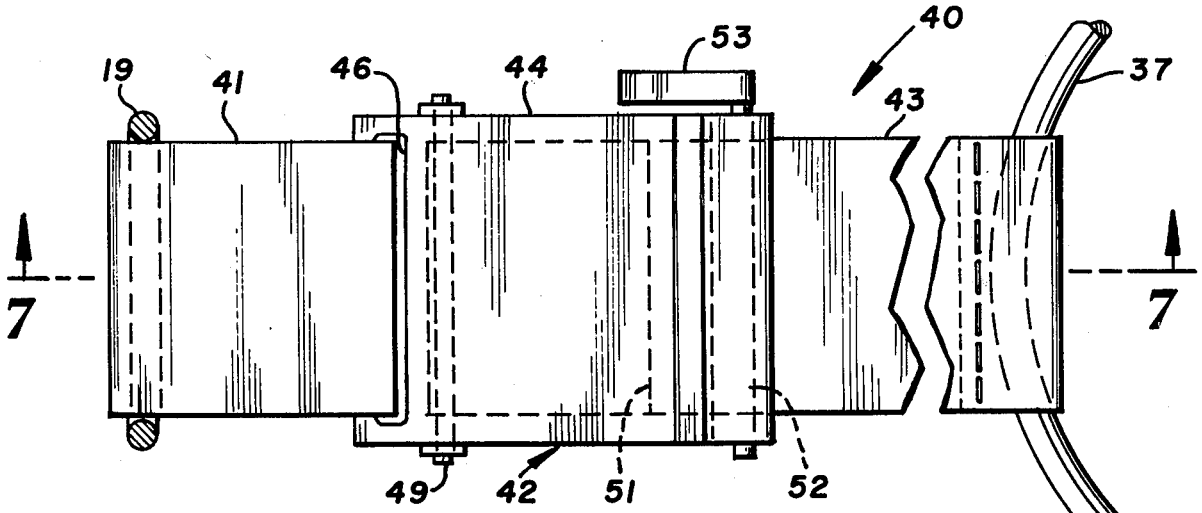
FIG. 6 is a foreshortened top plan view of a modified link usable with the accordion support apparatus.
Figure 7:
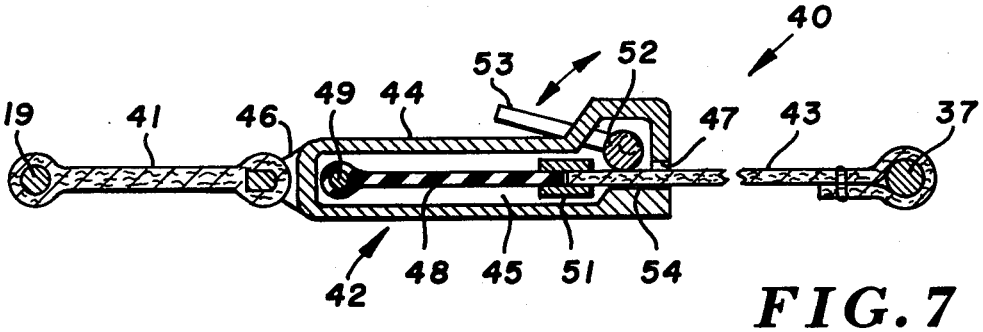
FIG. 7 is a sectional view taken along line 7—7 of FIG. 6

Referring to FIGS. 6 and 7, there is shown a modification of the link assembly connecting member 19 on the bottom of accordion section 12 to ring 37 indicated generally at 40. Link assembly 40 has a first strap 41 extended around U-member or hardware 19 and connected to an extendable and retractable unit 42. A second strap 43 extends from unit 42 around a portion of ring 37.

Unit 42 has a generally flat rectangular body or casing 44 having an inside chamber 45. The left end or inner end of body 44 has a transverse slot 46 for accommodating a portion of first strap 41 thereby connecting the strap 41 to unit 42. The right end of body 44 has a transverse opening 47 open to chamber 45 accommodating a portion of the second strap 43. Second strap 43 extends through opening 47 into chamber 45. A flat elastic band or spring 48 located in chamber 45 is connected to a transverse pin 49 mounted on the side walls of body 44. A flat connector 51 joins the adjacent ends of elastic band 48 to second strap 43.

Second strap 43 is held in fixed selected positions on body 44 with an eccentric locking sleeve 52. Opposite ends of sleeve 52 are rotatably mounted on the opposite portions or walls of body 44. A control lever 53 is secured to one of the extensions of sleeve 52. A second control lever (not shown) can be joined to the opposite end of sleeve 52. As shown in FIG. 7, sleeve 52 is located above an abutment 54 having an upper flat surface engageable with the flat bottom side of second strap 43. Eccentric locking sleeve 52 can be rotated in a counterclockwise direction toward body 44, as shown in FIG. 7, to clamp second strap 42 onto abutment 54. Sleeve 52 is released from strap 43 by moving lever 53 in an upward direction away from body 44.

The elastic band 48 permits second strap 43 to be extended from body 44 thereby increasing the length of the link assembly 37. When accordion 10 is to be played with the musician in the seated position, it is desirable to increase the length of the link assembly 40. This can be done by lifting the locking lever 53 thereby releasing the lock sleeve 53. The accordion can be moved away from the body of the musician to the desired position. The elastic band will elongate. Lever 53 is then moved back down to the lock position thereby clamping the second strap 43 on abutment 54. When lever 53 is released, elastic band 48 will automatically retract second strap 43 into chamber 45 thereby shortening the length of the link assembly 40. Returning the lever 53 back to the lock or down position will again clamp second strap 43 to abutment 54. It is understood that other types of releasable lock mechanisms can be used to change the length of link assembly 40.

In use, accordion 10 is lifted in front of the musician 11. Shoulder straps 17 are placed over the shoulders, as shown in FIGS. 1 and 2. An example of two shoulder straps used with an accordion is shown by Chlumsky in U.S. Pat. No. 2,808,188. Some musicians use a single shoulder strap to facilitate the carrying and stabilizing of accordion 10.

Accordion support assembly 21 is placed around the waist of musician 11. The first hook 27 is snapped into ring 37. In a similar manner the second hook 29 is snapped into ring 37. Accordion 10 is now supported by belt 22 through the link assembly 23. Shoulder straps 17 are used to stabilize accordion 10 in front of musician 11. The length of link assembly 23 can be adjusted by changing the position of the buckle 38 to locate the accordion in a convenient playing position in front of the musician. Link assembly 23 can have a fixed length selected by the musician.

When link assembly 40 is used in lieu of link assembly 38, musician 11 can automatically adjust the length of link assembly 40. This is done by releasing the lock lever 53 thereby moving the lock sleeve 52 to a release position away from second strap 43. Second strap 43 can now be pulled from body 44 or retracted into body 44 by elastic band 48. When link assembly 39 has the desired length, lever 53 is moved down to the lock position whereby the lock sleeve 52 forces second strap 43 into locking engagement with abutment 54. The adjustment of link assembly 40 can be made without removing the support belt assembly 21 or accordion 10 from musician 11.

While there has been shown and described the preferred embodiments of the accordion support assembly and link assembly for holding an accordion in playing position in front of a musician, it is understood that changes in the belt assembly and link assembly can be made by those skilled in the art without departing from the invention.

The embodiments of the invention in which an exclusive property or privilege is claimed are defined as follows:

1. An apparatus for supporting an accordion on a player, said accordion having an upper end and a lower end, and shoulder strap means connected to the upper and lower end adapted to be located about at least one shoulder of a player, comprising: a flexible belt adapted to surround the waist of the player, means for adjusting the length of the belt, said belt having a first end and a second end, a flexible link having a first end and a second end, means connecting said first end of the link to the lower end of the accordion to allow the link to move relative to the accordion, ring means pivotally connected to the second end of the link allowing the ring means to pivot relative to the second end of the link, first hook means attached to the first end of the belt, said first hook means being releasably connected to the ring means, and second releasable hook means attached to the second end of the belt, said second hook means being releasably connected to the ring means whereby the belt, ring means, and link support the accordion from the waist of the player.

2. The apparatus of claim 1 wherein: the link is a strap.

3. The apparatus of claim 2 wherein: the strap has means for adjusting the length of the strap.

4. The apparatus of claim 1 wherein: the link includes means for adjusting the length of the link.

5. An apparatus for supporting an accordion on a player, said accordion having an upper end and a lower end, and shoulder strap means connected to the upper and lower end adapted to be located about at least one shoulder of a player, comprising: first means adapted to surround the waist of the player, said first means having a first end and a second end, a flexible link having a first end and a second end, means connecting said first end of the link to the lower end of the accordion to allow the link to move relative to the accordion, ring means connected to the second end of the link, first connector means attached to the first end of the first means and the ring means, and second connector means attached to the second end of the first means and the ring means whereby the first means and link support the accordion from the waist of the player, said link means including means for adjusting the length of the link, said means for adjusting the length of the link including an elastic means elongatable to increase the length of the link, and releasable lock means operable to hold the link at a selected length, said lock means being releasable whereby the elastic means contracts to decrease the length of the link.

6. The apparatus of claim 5 wherein: the first and second connector means each are releasable hooks.

7. An apparatus for supporting an accordion on a player, said accordion having an upper end and a lower end, and shoulder strap means connected to the upper and lower end adapted to be located about at least one shoulder of a player, comprising: first means adapted to surround the waist of the player, said first means having a first end and a second end, a flexible link having a first end and a second end, means connecting said first end of the link to the lower end of the accordion to allow the link to move relative to the accordion, ring means connected to the second end of the link, first connector means attached to the first end of the first means and the ring means, and second connector means attached to the second end of the first means and the ring means whereby the first means and link support the accordion from the waist of the player, an extendable and retractable unit operable to change the length of the link, said extendable and retractable unit including a casing having a chamber and a slot open to the chamber, a first strap connecting the casing to the lower end of the accordion, an elastic means located in the chamber means connecting the elastic means to the casing, a second strap extended through the slot and connected to the elastic means and the second means, a releasable lock mounted on the casing operable to hold the second strap in a fixed position on the casing thereby fixing the length of the link, said lock being releasable from the second strap whereby the elastic means retracts the second strap into the chamber, shortening the length of the link.

8. The apparatus of claim 7 wherein: the first and second connector means each are releasable hooks.

9. The apparatus of claim 7 wherein: the first means is an elongated flexible belt, said first and second connector means are releasable hooks connected to opposite ends of the belt, and said ring means comprises a circular ring connected to the second end of the link, said hooks being connectable to the ring to locate the belt about the waist of the player.

10. The apparatus of claim 9 wherein: each hook is a snap hook.

11. The apparatus of claim 9 wherein: said link is an endless strap extended through the ring, said strap having means for adjusting the length of the strap.

12. An apparatus used by an accordion player to locate and carry an accordion in a playing position, said accordion having an upper end and a lower end comprising: shoulder strap means connected to the upper end and lower end of the accordion, a belt adapted to surround the waist of the player, said belt having a first end and a second end, a flexible link having a first end and a second end, means connecting said first end of the link to the lower end of the accordion to allow the link to move relative to the accordion, a ring connected to the second end of the link, first connector means attached to the first end of the belt, said first connector means being releasably connected to the ring, and second connector means attached to the second end of the belt, said second connector means being releasably connected to the ring whereby when the first and second connector means are connected to the ring the belt, ring, and link support the accordion from the waist of the player and when either of the first and second connector means are released from the ring the belt can be removed from the player's waist.

13. The apparatus of claim 12 wherein: said belt includes means for adjusting the length of the belt.

14. The apparatus of claim 12 including: an extendable and retractable unit for changing the length of the link.

15. An apparatus used by an accordion player to locate and carry an accordion in a playing position, said accordion having an upper end and a lower end comprising: shoulder strap means connected to the upper end and lower end of the accordion, a belt adapted to surround the waist of the player, said belt having a first end and a second end, a flexible link having a first end and a second end, means connecting said first end of the link to the lower end of the accordion to allow the link to move relative to the accordion, a ring connected to the second end of the link, first connector means attached to the first end of the belt and connected to the ring, and second connector means attached to the second end of the belt and connected to the ring whereby the belt and link support the accordion from the waist of the player, an extendable and retractable unit for changing the length of the link, said extendable and retractable unit including a casing having a chamber and a slot open to the chamber, a first strap connecting the casing and accordion, an elastic band located in the chamber, means connecting one end of the elastic band to the casing, a second strap extended through the slot and connected to the other end of the elastic band, said second strap being connected to the ring, an eccentric lock rotatably mounted on the casing and engageable with the second strap to hold the second strap in a fixed position on the casing thereby fixing the length of the unit, said lock being releasable from the second strap whereby the elastic means retracts the second strap into the chamber, shortening the length of the link.

16. The apparatus of claim 12 wherein: the link is a strap, said strap including means for adjusting the length of the link.

17. An apparatus used by an accordion player to locate and carry an accordion in a playing position, said accordion having an upper end and a lower end comprising: shoulder strap means connected to the upper end and lower end of the accordion, a belt adapted to surround the waist of the player, said belt having a first end and a second end, a flexible link having a first end and a second end, means connecting said first end of the link to the lower end of the accordion to allow the link to move relative to the accordion, a ring connected to the second end of the link, first connector means attached to the first end of the belt and connected to the ring, and second connector means attached to the second end of the belt and connected to the ring whereby the belt and link support the accordion from the waist of the player, said link includes means for adjusting the length of the link, said means for adjusting the length of the link including an elastic means elongatable to increase the length of the link, and releasable lock means operable to hold the link at a selected length, said lock means being releasable whereby the elastic means contracts to decrease the length of the link.

18. The apparatus of claim 12 wherein: the first and second connector means each are releasable snap hooks.

* * * * *